United States Patent [19]

Vork

[11] 4,050,859

[45] Sept. 27, 1977

[54] DIAPHRAGM PUMP HAVING A REED VALVE BARRIER TO HYDRAULIC SHOCK IN THE PRESSURIZING FLUID

[75] Inventor: William Duncan Vork, Edina, Minn.

[73] Assignee: Graco Inc., Minneapolis, Minn.

[21] Appl. No.: 701,807

[22] Filed: July 1, 1976

[51] Int. Cl.[2] ..... F04B 9/08; F04B 35/02

[52] U.S. Cl. ..... 417/386; 417/388; 417/395; 92/100

[58] Field of Search ..... 417/383, 384, 385, 386, 417/387, 388, 395; 92/99, 100; 137/85.5

[56] References Cited

U.S. PATENT DOCUMENTS

| | | | |
|---|---|---|---|
| 1,788,886 | 1/1931 | Nutt | 417/384 |
| 2,303,597 | 12/1942 | Adelson | 417/386 |
| 2,919,650 | 1/1960 | Wiggerman | 417/386 |
| 2,948,223 | 8/1960 | Mashinter | 417/387 |
| 3,075,468 | 1/1963 | Eifel | 417/386 |
| 3,285,182 | 11/1966 | Pinkerton | 417/386 |
| 3,354,830 | 11/1967 | Mortara | 92/100 |
| 3,367,270 | 2/1968 | Schlosser | 417/388 |

*Primary Examiner*—Carlton R. Croyle
*Assistant Examiner*—Thomas I. Ross
*Attorney, Agent, or Firm*—Paul L. Sjoquist

[57] ABSTRACT

Apparatus for an improved diaphragm pump wherein hydraulic shock and mechanical wear to the diaphragm membrane is reduced by providing a circular reed valve member adjacent to the diaphragm. The reed valve member provides a barrier to pressurized hydraulic fluid jets from direct impingement upon the diaphragm membrane, and provides a valve closure member for reducing hydraulic shock effects on the diaphragm membrane.

13 Claims, 3 Drawing Figures

DIAPHRAGM PUMP HAVING A REED VALVE BARRIER TO HYDRAULIC SHOCK IN THE PRESSURIZING FLUID

CROSS-REFERENCE TO RELATED APPLICATIONS

The present invention comprises an improvement to diaphragm pump construction wherein the driving mechanism is a mechanically reciprocated piston. A driving mechanism for the present invention is disclosed in U.S. application Ser. No. 593,449, filed July 7, 1975, now U.S. Pat. No. 4,019,395 entitled "Piston Drive Assembly." An apparatus for relieving excess hydraulic fluid pressure in a diaphragm pump arrangement, and which may be adapted for use with the present invention is disclosed in U.S. application Ser. No. 582,262, filed May 30, 1975, now U.S. Pat. No. 4,019,837 entitled "Pressure Unloading Apparatus For A Diaphragm Pump." A further apparatus for relieving excess hydraulic fluid pressures in a diaphragm pump which is adaptable for use with the present invention is disclosed in U.S. application Ser. No. 560,210, filed Mar. 20, 1975, now U.S. Pat. No. 3,957,399 entitled "Diaphragm Pump." Each of the foregoing applications is owned by the assignee of the present invention, and the disclosure of each of these co-pending applications is incorporated herein by reference.

BACKGROUND OF THE INVENTION

In the field of diaphragm pump design, one of the most persistent problems in developing a lasting and efficient pump is in choosing a design which will eliminate or minimize diaphragm membrane rupture. It has not been uncommon to replace diaphragm membranes after only several hundred hours of use because of rupture and/or wear of the membrane, particularly when the pump is adapted for delivering higher fluid pressures. Diaphragm pumps may deliver 100–1,000 p.s.i. fluid pressures by moving the diaphragm membrane under hydraulic fluid pressure control, and so long as the pressure of the hydraulic driving fluid is equalized by the driven fluid pressure across the surface of the diaphragm the membrane will not rupture. However, transient pressure changes caused by intermittent delivery of pumped fluid, and by changes in the direction of diaphragm reciprocation, frequently cause pressure shock waves over portions of the membrane surface. These shock waves create extremely high instantaneous forces against the membrane and over a period of time may cause wear which eventually ruptures the membrane. It is desirable to minimize such shock waves, because the membrane, although inherently resilient, cannot indefinitely withstand large transient forces which are not distributed evenly over its surface.

Prior art devices have largely solved this problem by constructing surfaces in the diaphragm pumping chamber which limit the reciprocation travel of the diaphragm, but which have passages therethrough for the flow of pressurized hydraulic fluid. Under highly pressurized conditions these passages are subjected to transient hydraulic fluid pressures which are transferred to the adjacent membrane surface. For example, if the diaphragm membrane is reciprocated by means of a mechanically reciprocating piston acting upon hydraulic fluid, the change in reciprocation direction of the piston caused by a hydraulic shock wave to be propagated through the passages directly to the diaphragm membrane which is exposed by the passages. This causes an instantaneous force against that portion of the diaphragm membrane which does not become equalized until the membrane moves away from contact with the stop surface. Over a period of time this causes wear to the diaphragm membrane in the region adjacent the hydraulic fluid passages and ultimately will cause the diaphragm to rupture.

SUMMARY OF THE INVENTION

The invention disclosed herein comprises a resilient diaphragm membrane interposed in a chamber to form a first chamber section for containing pumped liquid and a second chamber section for containing hydraulic pumping fluid. The second chamber section has a contoured surface with a narrowed inlet aperture sized to snugly accept a diaphragm stop washer. The diaphragm stop washer and the diaphragm membrane are secured together on a stem and are separated by a circular reed valve member which contacts the contoured chamber surface in sealing relationship whenever the stop washer is seated within the narrowed aperture.

BRIEF DESCRIPTION OF THE DRAWINGS

A preferred embodiment of the present invention is disclosed herein, and is shown on the accompanying drawings, in which.

DESCRIPTION OF THE PREFERRED EMBODIMENT

Figure 1:
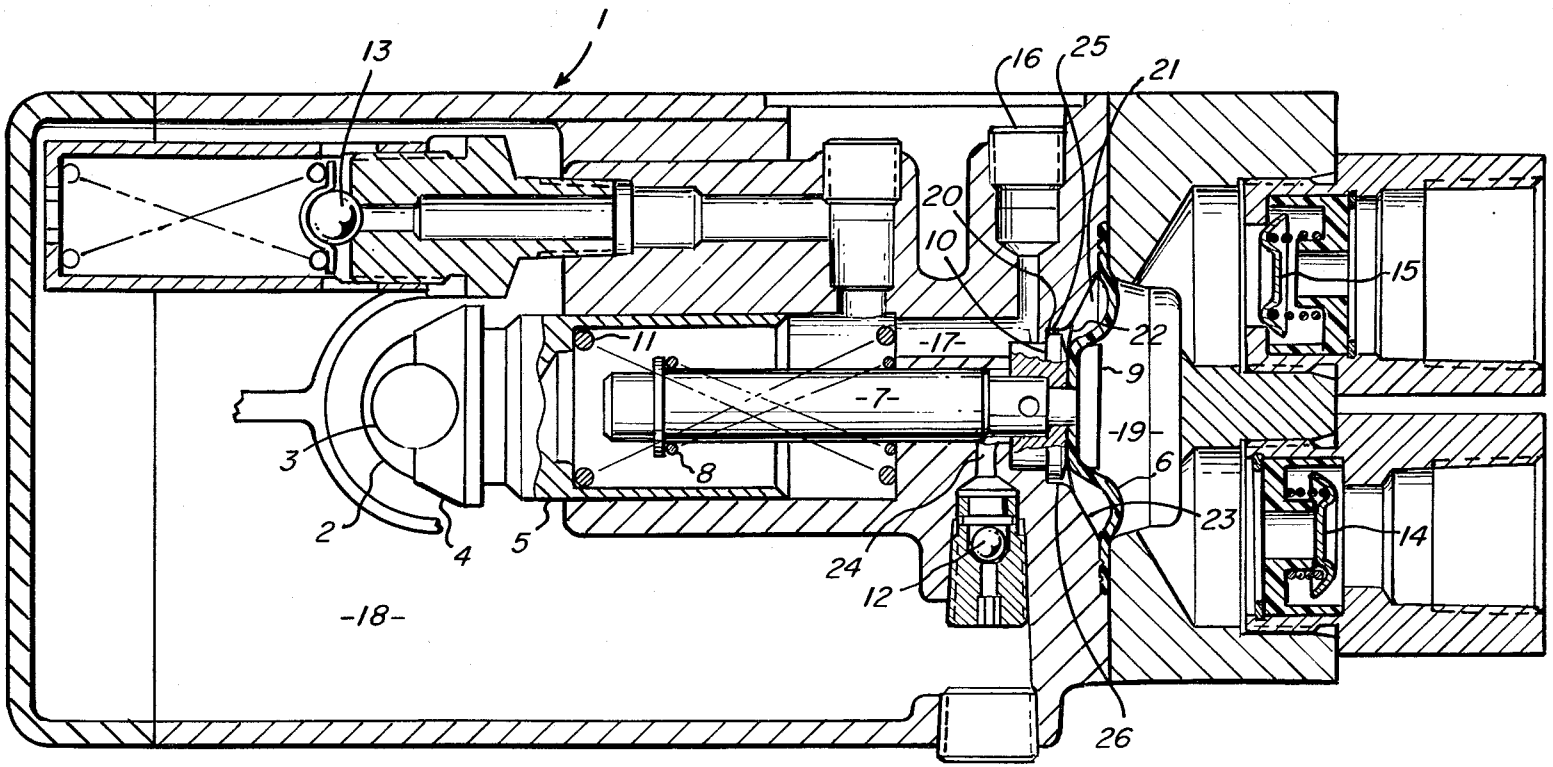
FIG. 1 shows a diaphragm pump in cross section view.

Referring first to FIG. 1, a diaphragm pump including the present invention is shown in cross section. The apparatus is enclosed in a housing 1 which sealably contains the hydraulic oil or fluid necessary to the operation of the invention. A rotatable crank shaft 2 is mechanically connected to a power source such as an electric motor. An eccentric 3 forms a part of crank shaft 2 and rotates therewith. Bearing shoe 4 rides against eccentric 3 and moves a piston 5. Piston 5 and bearing shoe 4 are spring-loaded by spring 11 so as to maintain contact against eccentric 3. The detailed description of this mechanical reciprocation system is described in co-pending U.S. application Ser. No. 593,449, filed July 7, 1975, now U.S. Pat. No. 4,019,395 and owned by the same assignee as the present invention.

Hydraulic oil or other similar fluid is contained within a reservoir 18 which is ported into a hydraulic chamber 17 via an inlet valve 12. A relief valve 13 provides a return path between hydraulic chamber 17 and reservoir 18. Under normal operating conditions hydraulic chamber 17 becomes filled with hydraulic oil, and the reciprocation of piston 5 causes this oil to become alternately pressurized and relieved. During the pressure stroke of piston 5, the hydraulic oil in chamber 7 forces diaphragm 6 forward into a pumping chamber 19. During the return stroke of piston 5, hydraulic oil pressure in chamber 17 is relieved and diaphragm 6 is urged rearwardly by a diaphragm return spring 8. If an excess amount of hydraulic oil has accumulated in chamber 17 this excess oil will be returned to reservoir 18 during the piston 5 pressure stroke through an adjustable relief valve 13. If a deficiency in hydraulic fluid occurs in chamber 17 additional hydraulic fluid will be admitted into chamber 17 via inlet valve 12 during the return stroke of piston 5. Inlet valve 12 is a ball check which lifts off its seat upon the occurrence of negative pressure in chamber 17 as compared with reservoir 18. Relief valve 13 is an adjustable spring- loaded ball valve which opens upon the application of a predetermined pressure against the valve.

A pump inlet valve 14 opens during the piston 5 return stroke to admit pumped liquid into pumping chamber 19. A pump outlet valve 15 opens during the pressure stroke of piston 5 to pass pumped liquid from chamber 19 to the pump outlet. The opening and closing of these valves is caused by the reciprocation of piston 5, acting to reciprocate diaphragm 6 through the pressurized hydraulic oil. The operation of diaphragm 6 in conjunction with the inlet and outlet pump valves is well known in the art and need not be further described herein.

Diaphragm 6 is clamped between a diaphragm clamp 9 and a diaphragm stop washer 10, both of which are fastened to a valve spool 7. Valve spool 7 is spring-biased by diaphragm return spring 8 to urge diaphragm 6 toward a rearward position. When valve spool 7 is in its rearmost position it uncovers a hydraulic inlet port 24 to allow hydraulic oil to pass through valve 12 into chamber 17.

Interposed between diaphragm stop washer 10 and diaphragm 6 is a circular reed valve member 22. Member 22 contacts chamber wall 23 whenever diaphram 6 is in its rearmost position. The operation of reed valve 22 will be described more fully hereinafter, with reference to FIG. 2A and 2B.

Figure 2B:
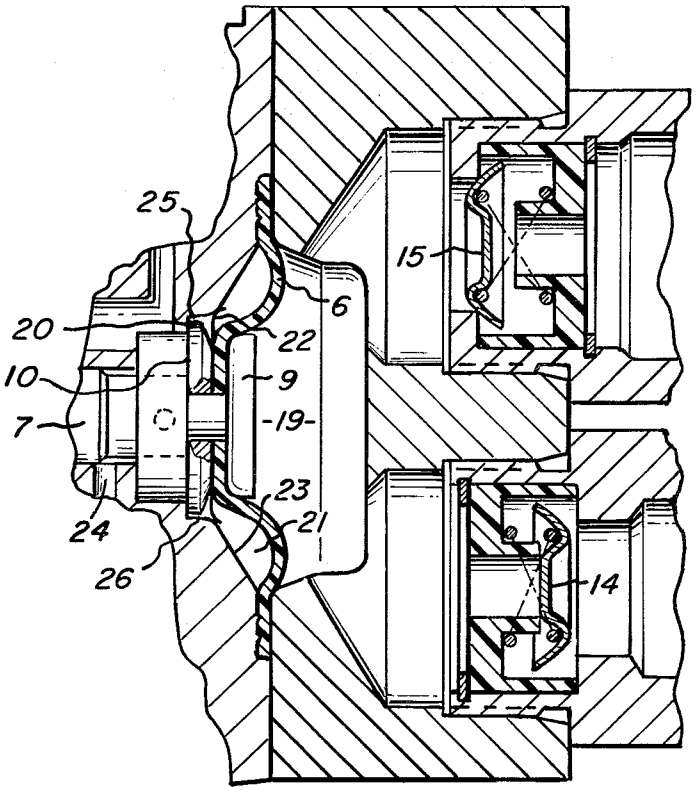
FIG. 2B shows the diaphragm chamber in cross section and in a second diaphragm position.
Figure 2A:
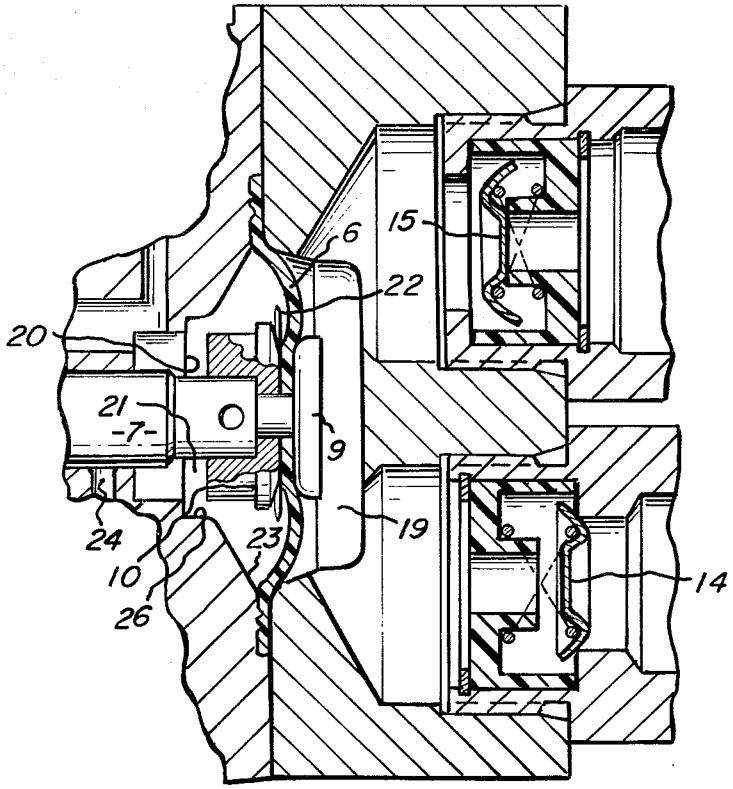
FIG. 2A shows the diaphragm chamber in cross section and in a first diaphragm position.

FIG. 2A shows the diaphragm and its associated chambers in cross section view, with the diaphragm in a forward position. This position corresponds to the pressure stroke of the piston, and results in the opening of pump outlet valve 15 and the closing of pump inlet valve 14. Valve spool 7 is in its forward position, and diaphragm stop washer 10 is lifted clear of its seats in aperture 26. Reed valve 22 is raised free from any contact with surface 23, and pressurized hydraulic oil acts over the entire diaphragm membrane surface are in diaphragm chamber 21. The volume of pumping chamber 19 is reduced because pumped liquid has been ejected through pump outlet valve 15.

FIG. 2B shows the diaphragm chambers in cross section and in a second diaphragm position. This position corresponds to the position of piston 5 at its maximum return stroke. The volume of pumping chamber 19 is maximum and pump liquid is being drawn into pumping chamber 19 through inlet valve 14. Diaphragm stop washer 10 is seated within aperture 26 so as to limit any further rearward movement of diaphragm 6. It should be noted that diaphragm stop washer 10 is firmly seated against stop surface 20, but a narrow annular clearance 25 exists between the outer circumference of washer 10 and the inner aperture 26 diameter. This narrow annular opening provides a passage for emitting pressurized hydraulic oil into chamber 21 as piston 5 begins its forward or pressure stroke. In other words, as soon as piston 5 begins its forward or pressure stroke, diaphragm stop washer 10 lifts from its seat against surface 20 and permits pressurized hydraulic oil to flow into chamber 21 via annular clearance 25. This pressurized annular sheet of hydraulic oil impinges upon reed valve member 22, which deflects the oil toward chamber wall 23 and away from direct contact with diaphragm 6. In this manner, member 22 protects diaphragm 6 from wear caused by the pressurized hydraulic oil shock wave.

When diaphragm stop washer 10 is seated in aperture 26 reed valve member 22 contacts chamber surface 23. This contact temporarily isolates diaphragm chamber 21 from hydraulic chamber 17 to prevent any transient hydraulic pressure shock impulses which may be developed in hydraulic chamber 17 from being directly coupled into diaphragm chamber 21. Further, in the event of a rupture of diaphragm 6, reed valve member 22 provides an auxiliary seal to prevent pumped liquid from passing into hydraulic oil reservoir 18. In this case, member 22 acts as a safety valve to isolate the pumped liquid from the hydraulic oil and thereby prevent pumped liquid from contaminating the interior mechanism of the pump.

The operation of reed valve member 22, since it is critical to the present invention, will be more fully described at this time. When the piston 5 and diaphragm 6 have completed their forward stroke and begun the return stroke, diaphragm return spring 8 urges valve spool 7 and diaphragm stop washer 10 toward surface 20 in aperture 26. As diaphragm stop washer 10 approaches surface 20 the flow of hydraulic oil from diaphragm chamber 21 is progressively restricted after washer 10 enters aperture 26. The area of clearance between the outside diameter of washer 10 and aperture 26 has been selected to be approximately equal to a ¼ inch diameter hole. When washer 10 contacts surface 20 and reed valve member 22 contacts chamber surface 23, the passage between diaphragm chamber 21 and hydraulic chamber 17 becomes completely closed. This action keeps diaphragm 6 in a fully charged position and prevents wrinkling and fatique to the diaphragm membrane. Also, with the diaphragm 6 and diaphragm washer 10 in this position, inlet port 24 is in open communication between hydraulic oil chamber 17 and reservoir 18. In the event that some hydraulic oil has been lost during the piston pressure stroke, hydraulic chamber 17 will be fully replenished at this time. When piston 5 drives forward toward diaphragm 6, oil in hydraulic chamber 17 becomes pressurized and hydraulic oil pressure lifts diaphragm stop washer 10 from contact with surface 20. This causes pressurized hydraulic oil to be forced through the annular space between diaphragm stop washer 10 and aperture 26, which oil impinges upon member 22 and becomes deflected outward toward surface 23. This creates a controlled and diffused fluid flow and pressurizes diaphragm chamber 21 with a smooth gradient to prevent hydraulic shock which might otherwise fatique and damage diaphragm 6. As the hydraulic oil pressure increases over the entire area of diaphragm 6 the flow path through aperture 26 increases and the diaphragm stop washer 10 and reed valve member 22 raise from contact with their respective surfaces, and diaphragm chamber 21 pressurizes with a smooth pressure gradient.

What is claimed is:

1. An improvement in diaphragm pumps of the type having a mechanically reciprocating member for pressurizing hydraulic oil for reciprocating a diaphragm member to transfer fluid through inlet and outlet valves into and out of a pumping chamber adjacent a first side of the diaphragm, comprising:

a. a hydraulic chamber of containing hydraulic oil in fluid contact with said mechanically reciprocating member;

b. a diaphragm chamber adjacent a second side of said diaphragm and having a narrowed aperture opening into said hydraulic chamber;

c. a mechanical stop member connected to said diaphragm and sized to fit into said narrowed aperture opening; and d. a flexible reed valve member secured between said diaphragm and said mechanical stop member, said flexible reed valve member being sized to contact said diaphragm chamber in fluid flow sealing relationship between said diaphragm chamber and said narrowed aperture when said mechanical stop member is in said narrowed aperture opening, and to deflect pressurized hydraulic fluid from direct impingement on said diaphragm when said mechanical stop member moves away from said narrowed aperture opening.

2. The apparatus of claim 1 wherein said narrowed aperture opening further comprises a recessed shoulder for seating against said mechanical stop member.

3. The apparatus of claim 2 wherein said flexible reed valve member has a surface area larger than the cross section area of said narrowed aperture opening.

4. The apparatus of claim 3 further comprising a valve spool attached to said mechanical stop member and projecting into said hydraulic chamber; a port in said hydraulic chamber positioned so as to become uncovered when said mechanical stop member is seated against said recessed shoulder; and a one-way valve in said port.

5. The apparatus of claim 4, further comprising spring bias means for urging said mechanical stop member toward said recessed shoulder.

6. The apparatus of claim 5 further comprising a reservoir for containing hydraulic oil, connected in fluid contact with said one-way valve in said port.

7. The apparatus of claim 6 further comprising a passage between said hydraulic chamber and said reservoir, and said passage having therein a spring- biased ball check to pass hydraulic oil between said hydraulic chamber and said reservoir at a predetermined hydraulic oil pressure in said hydraulic chamber.

8. In a diaphragm pump having a reciprocating member for hydraulically actuating a diaphragm member for pumping fluid into and out of a pumping chamber through inlet and outlet valves, the improvement comprising:

a. a diaphragm chamber adjacent the diaphragm for containing hydraulic fluid, said diaphragm chamber having a narrowing contour to an inlet sized smaller than the diaphragm;

b. a recessed shoulder in said inlet;

c. an elongated stem attached to said diaphragm and passing through said inlet;

d. a flexible reed valve member attached adjacent said diaphragm on said stem, said flexible reed valve member being sized smaller than said diaphragm and larger than said inlet; and e. a mechanical stop member attached to said stem adjacent said flexible reed valve member, said stop member being sized to fit into said inlet and seat against said recessed shoulder, whereby the unseating of said stop member creates an annular clearance for the flow of pressurized hydraulic fluid which impinges upon said flexible reed valve member.

9. The apparatus of claim 8, further comprising a valve spool formed on said stem adjacent said mechanical stop member.

10. The apparatus of claim 9, further comprising a hydraulic chamber for containing hydraulic fluid in fluid contact with said inlet and with said reciprocating member.

11. The apparatus of claim 10, further comprising a reservoir for containing a supply of hydraulic fluid, and a first passage between said reservoir and said hydraulic chamber, said passage having a one-way valve therein.

12. The apparatus of claim 11, wherein said valve spool is positioned to uncover said first passage when said mechanical stop member is seated against said recessed shoulder.

13. The apparatus of claim 12, further comprising a second passage between said hydraulic chamber and said reservoir, said second passage having therein a spring-biased valve to prevent fluid flow between said hydraulic chamber and said reservoir below a predetermined hydraulic chamber fluid pressure.

* * * * *